United States Patent [19]

Obata et al.

[11] Patent Number: 4,876,847

[45] Date of Patent: Oct. 31, 1989

[54] RING SPINNING MACHINE

[75] Inventors: Takeshi Obata, Narashino; Hideaki Kobayashi, Sakura, both of Japan

[73] Assignee: Hitachi, Ltd., Tokyo, Japan

[21] Appl. No.: 147,326

[22] Filed: Jan. 22, 1988

[30] Foreign Application Priority Data

Jan. 23, 1987 [JP] Japan ..... 62-12311

[51] Int. Cl.[4] ..... D01H 1/244; D01H 7/08

[52] U.S. Cl. ..... 57/100; 57/129

[58] Field of Search ..... 57/100, 119–122, 57/129–135, 75

[56] References Cited

U.S. PATENT DOCUMENTS

| | | | |
|---|---|---|---|
| 1,840,642 | 1/1932 | Stone | 57/100 X |
| 3,095,687 | 7/1963 | Beerli | 57/100 |
| 3,785,140 | 1/1974 | Muller | 57/100 |
| 4,361,004 | 11/1982 | Hartmannsgruber | 57/100 |

FOREIGN PATENT DOCUMENTS

| | | |
|---|---|---|
| 49-20445 | 2/1974 | Japan . |
| 54-32864 | 10/1979 | Japan . |
| 58-109633 | 6/1983 | Japan . |

*Primary Examiner*—John Petrakes

*Attorney, Agent, or Firm*—Antonelli, Terry & Wands

[57] ABSTRACT

A ring spinning machine has a direct drive spindle rotatably supported by an upper bearing in a bolster and connected to a rotor of a spindle motor having an upper structure including upper coil end of a stator thereof. A ring is movable up and down along the spindle to guide a yarn to be wound on a bobbin carried by the spindle. The inside diameter of the ring is determined in relation to the size of the upper structure of the spindle motor such that the upper structure can be received at least partially in the ring when the ring is moved to the lower end of its vertical stroke. The length of the unsupported portion of the spindle is reduced to increase the critical or resonance speed of the spindle, thus enabling the spindle to operate at an increased speed.

14 Claims, 4 Drawing Sheets

RING SPINNING MACHINE

BACKGROUND OF THE INVENTION

The present invention relates to a ring spinning machine and, more particularly, to an improvement in the construction of a ring spinning machine of, the type which is suited to high-speed operation and which has a direct drive spindle which is driven directly by an electric motor.

A ring spinning machine has been known which has a direct drive spindle (referred to simply as "spindle" hereinafter) which is driven directly by an electric motor. The spindle has a ring for guiding a yarn to be wound on the spindle and a ring rail for supporting the ring and is constructed such that the lower end of the range through which the ring and the ring rail move is positioned above the motor structure of the spindle. This type of spindle is disclosed, for example, in Japanese Patent Examined Publication No. 54-32864 and Japanese Patent Unexamined Publication Nos. 49-20445 and 58-109633.

Such spindles are required to operate at a high speed to comply with a demand for higher production efficiency in yarn spinning process. Unfortunately, however, the spindle of the conventional construction could not sufficiently meet this requirement because the rotation speed of the spindle is limited due to the presence of a resonance speed in primary flexural mode which appears between the upper free end of the spindle and the portion of the spindle held by an upper bearing in a bolster which supports the spindle.

SUMMARY OF THE INVENTION

Accordingly, an object of the present invention is to provide a ring spinning machine incorporating a direct drive spindle which has a high resonance speed and, hence, can operate at a high speed.

To this end, according to the present invention, there is provided a ring spinning machine comprising: a bolster having an upper bearing provided in an upper portion thereof and a foot step bearing provided in a lower portion thereof; a spindle rotatably supported by the bolster and carrying a bobbin for winding yarn thereon; a substantially cylindrical ring having an upper end provided with a traveler for guiding the yarn to the bobbin; a ring rail connected with a base portion of the ring and capable of moving the ring up and down in the direction of the axis of the spindle; and a spindle motor having a motor rotor including a motor core fixed to the spindle and secondary windings on the rotor core and a motor stator including a cylindrical stator core surrounding the rotor core leaving an annular gap therebetween and a stator winding on the stator core; wherein the ring has an inside diameter greater than at least a part of the spindle motor so that the ring can be lowered to a position where it accommodates at least the part of the spindle motor.

In general, referring to FIG. 4, the resonance rotation speed of a cantilevered rotational member in primary flexural mode is determined by various factors such as the distance $l_1$ between the supporting point P and the centroid G of the member, the distance $l_2$ between the supporting point P and the free end of the member, the diameter d of the member and elastic modulus of the member. It is clear from the knowledge of dynamics of rotational member members the resonance speed in the primary flexural mode becomes higher as the lengths $l_1$ and $l_2$ become smaller provided that other factors are unchanged.

According to the invention, the ring or the ring rail and the motor structure are so constructed that the inside diameter of the ring or the ring rail is greater than the outside diameter of at least a part of the motor structure, thereby reducing the distance between the upper bearing in the bolster and the bobbin mounted on the spindle. This makes it possible to reduce the above-mentioned lengths $l_1$ and $l_2$, so that the resonance speed of the spindle in the primary flexural mode can be increased as compared with conventional spindle made of the same material and having the same diameter. Consequently, the spindle according to the invention can rotate at a speed higher than that of the conventional spindle without any risk of breakdown due to response.

DESCRIPTION OF THE PREFERRED EMBODIMENTS

Figure 1:
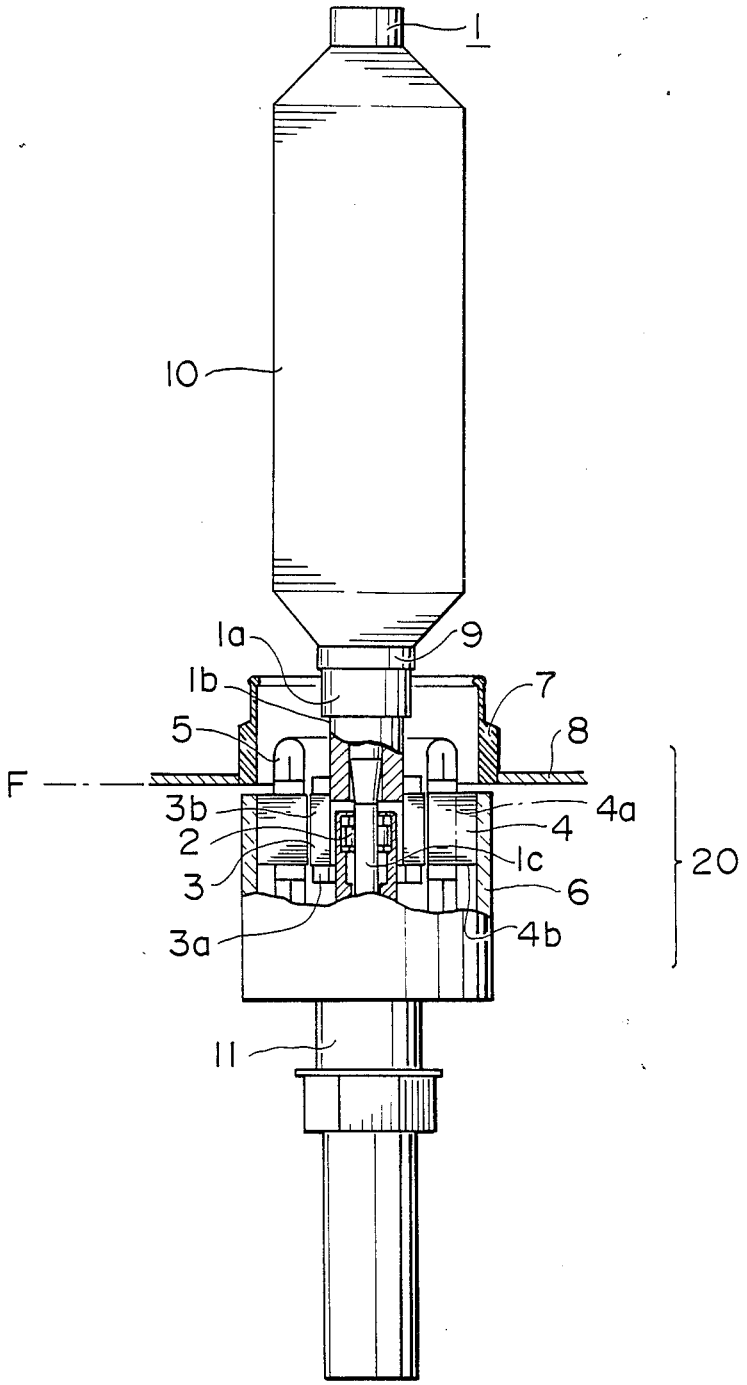
FIG. 1 is a partially sectioned elevational view of a spindle used in an embodiment of a ring spinning machine of the present invention.

A first embodiment of the present invention will be described hereinunder with reference to the accompanying drawings and, particularly, to FIG. 1.

A ring spinning machine of the present invention has a spindle 1 which has an integral structure composed of an upper blade 1*a*, a cylindrical wharve 1*b* and a lower blade 1*c*. A bobbin 9 on which a yarn is to be wound is mounted on the upper blade 1*a*. The lower end of the wharve is connected to a motor rotor 3 which is a part of the spindle motor 20 for driving the spindle 1. The lower blade 1*c* is rotatably supported by an upper bearing 2. The spindle motor 20 has a motor stator 4 which coaxially surrounds the motor rotor 3. The motor stator 4 is supported by a stator frame 6 which has an open-type structure with its upper end extended to the same level as the upper axial end of a stator core 4*b* of the motor stator 4. Thus, the stator frame 6 supports the motor stator 4 such that an upper coil end portion 5 of the motor stator 4 is exposed upwardly. The lower end of the stator frame 6 is connected to a bolster 11 which has the above-mentioned upper bearing 2 for supporting the spindle 1. Details of the bolster 11 are not shown because the bolster is constructed in a manner known per se. Briefly, the bolster has a lower foot step bearing which supports the lower end of the lower blade 1*c* of the spindle and a spiral leaf spring which supports the upper bearing 2 mentioned above so that the lower blade 1*c* of the spindle is resiliently restricted in the radial direction with a suitable level of spring constant and damping coefficient. The ring spinning machine further has a ring 7 and a ring rail 8 which are adapted to be moved up and down along the spindle 1 while they are guided in a manner known per se. The ring 7 has a cylindrical form and has a construction suitable for mounting a traveler on the upper end thereof, while the lower end thereof is fixed to the ring rail 8.

The spindle motor 20 is a 3-phase induction motor which is well known. More specifically, the motor 20 essentially has the motor rotor 3 and the motor stator 4 mentioned before. The motor rotor 3 has a rotor core 3*b* *l*which fits in a thin cylindrical wall constituted by a downward extension of the wharve l*b* of the spindle 1 and a secondary winding 3*a*, e.g., squirrel-cage winding, on the rotor core. The motor stator 4 has a tubular or cylindrical core 4*b* which surrounds the rotor core 3*b* leaving an annular space therebetween, and stator windings 4*a* formed on the stator core 4*b*. The stator windings 4*a* project above the upper end surface of the stator core 4*b*. The upper end of the stator windings 4*a* constitutes the upper coil end 5 mentioned before. The inner peripheral surface of the upper coil end 5 defines a cylindrical plane of a diameter greater than that of the cylindrical plane defined by the inner peripheral surface of the stator core 4*b*. The diameter of the cylindrical plane defined by the outer peripheral surface of the upper coil end 5 is smaller than that of the cylindrical plane defined by the outer peripheral surface of the stator core 4*b*.

The inside diameter of the ring 7 and the outside diameter of the upper coil end 5 are determined in relation to each other such that, when the ring rail 8 has been moved to the lower end F of its stroke, the upper coil end 5 of the rotor stator 4 of the spindle motor 20 is positioned within the inner peripheral surface of the ring 7. More specifically, in order to prevent mutual interference between the upper coil end 5 and the ring 7 the inside diameter of the ring 7 as well as the size of the ring rail 8 to which the base of the ring 7 is secured are determined to be slightly greater than the outside diameter of the upper coil end 5. In addition, the axial length of the ring 7 is so determined that the traveler is located at a position which is sufficiently spaced away from the upper coil end 5 in the axial direction of the spindle.

In operation of the ring spinning machine, the spindle is rotationally driven by the spindle motor 20 and the ring rail 8 is driven up and down along the bobbin 9 by a mechanism which is not shown. In consequence, the yarn is wound on the bobbin 9 through the traveler provided on the upper end of the ring 7.

Figure 4:
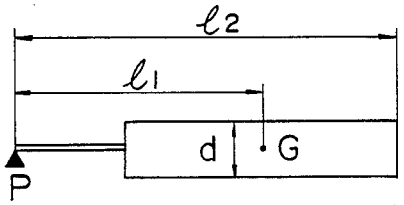
FIG. 4 is a diagrammatic illustration of vibration mode of a cantilevered rotary member.

In the described embodiment, the direct drive spindle and the spindle motor 20 are so designed that the upper portion of the spindle motor 20 and, particularly, the upper coil end 5 are received in the ring 7 when the ring rail 8 and, hence, the ring 7 are moved to the lower end of their stroke. This arrangement makes it possible to reduce the distance between the upper bearing 2 and the bobbin 9, that is to say, the length of the portion of the spindle 1 projecting above the upper bearing 2. In consequence, it is possible to reduce, as compared with the known spindle, the distance between the supporting point P (see FIG. 4) provided by the upper bearing 2 and the centroid G which can be regarded as being positioned at the center of the bobbin 9. As a result, the resonance speed is increased so as to allow the spindle to be operated at a higher rotation speed.

Figure 2:
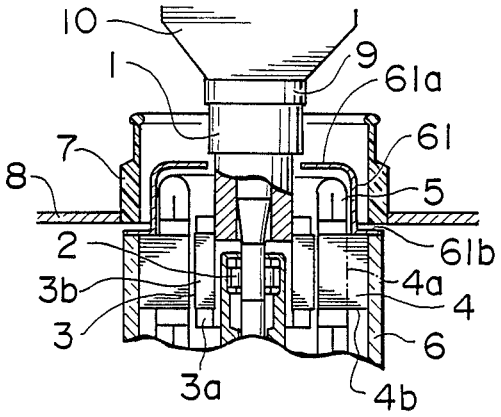
FIGS. 2 and 3 are fragmentary sectional elevational views of different embodiments of the present invention.

FIG. 2 shows another embodiment of the invention. This embodiment has an end cover 61 which is secured to the upper end of the stator frame 6 in such a manner as to cover the upper coil end 5 of the motor stator 4. More specifically, the end cover 61 has a thin-walled cylindrical central portion which surrounds the outer peripheral surface of the upper coil end 5, an annular top covering portion 6l*a* extending radially inwardly from the upper end of the central portion and defining a central opening through which the spindle 1 extends and a lower collar portion 6l*b* which extends radially outwardly from the lower end of the central portion along the top surface of the stator core 4*b* and the top of the stator frame 6 and is fixed to the stator frame 6. Thus, the embodiment shown in FIG. 2 is of a substantially hermetic construction.

Figure 3:
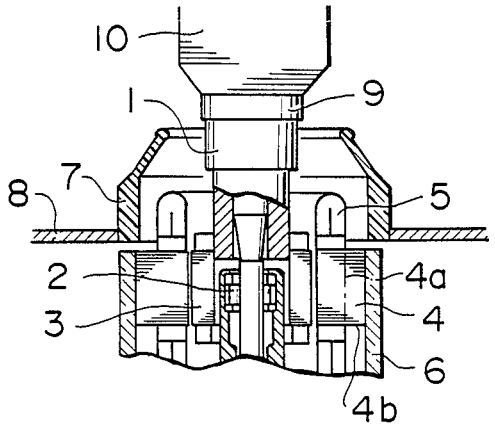

FIG. 3 shows still another embodiment in which the diameter of the upper end portion of the ring 7 is progressively decreased from the base portion of the ring 7. This embodiment is suitable for use in a case where the winding diameter of the yarn 10 on the bobbin 9 is comparatively small. In this embodiment, since the base portion of the ring 7 has an inside diameter large enough to accommodate the upper coil end 5 of the spindle motor 20, the length of the portion of the spindle 1 projected above the upper bearing 2 can be reduced as compared with known spindles, as in the cases of the preceding embodiments.

In the embodiments described hereinbefore, the inside diameter of the ring 7 and, hence, the diameter of an aperture in the ring rail 8 receiving and supporting the ring 7 are so determined that the ring 7 can accommodate at least a part of the structure of the spindle motor 20, e.g., the upper coil end 5 or the end cover 61. With this arrangement, it is possible to lower the ring 7 and the ring rail 8 beyond the upper end of the upper coil end 5 to a position close to the upper end of the stator frame 6.

A description will be made hereinunder as to a further embodiment with reference to FIGS. 5 to 9. A major point of improvement proposed by this embodiment resides in that the lower end portion of the wharve constituting the spindle 1 is extended to form a thin-walled cylindrical portion and a thick-walled ring portion connected to the lower end of the thin-walled cylindrical portion.

Figure 5:
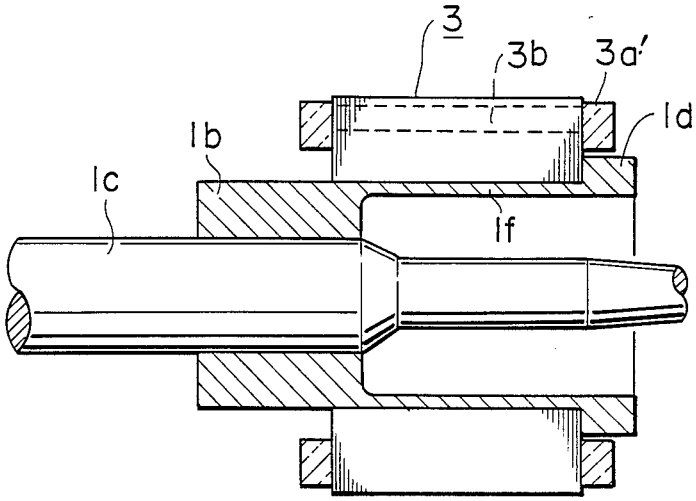
FIGS. 5, 6, 7, 8 and 9 are fragmentary sectional views of essential portions of modified embodiments.

FIG. 5 shows a first form of this embodiment. The wharve 1*b* is fixed to the lower blade 1*c*. The lower end portion (right end as viewed in FIG. 5) of the wharve 1*b* is extended downward, i.e., to the right as viewed in FIG. 5, so as to form a thin-walled cylindrical portion 1*f*. At the lower end of the thin-walled cylindrical portion 1*f*, the thickness is increased again so as to form a thick-walled ring portion 1*d* constituting the free lower end of the wharve l*b*. The rotor core 3*b* of the motor rotor 3 is fixed to the outer peripheral surface of the thin-walled cylindrical portion 1*f* such that the upper end portion of the rotor core 3*b* partially overlie the thick-walled portion of the wharve l*b*. The motor rotor 3 has an end ring 3*a*'. The thick-walled ring l*d* is placed inside the end ring 3*a*'. The upper end surface of the thick-walled ring 1*d* contacts the lower end surface of the rotor core 3*b*.

A motor rotor having an inside diameter which is large relative to the outside diameter, like the motor rotor 3, is regarded as being an annular member having a comparatively low rigidity and, hence, being easily deformable. In the spindle shown in FIG. 5, however, the motor rotor 3 is stiffened by the wharve of the spindle because the upper end of the motor rotor 3 fits on the outer peripheral surface of the upper thick-walled portion of the wharve 1*b* while the lower end portion of the motor rotor 3 is held by the thick-walled ring 1*d* integral with the wharve 1*b*. In consequence, the rigidity of the tubular structure including the motor rotor 3 is increased to provide a greater resistance to any deforming force caused during operation by higher harmonic electromagnetic force components, whereby the tendency of the tubular structure to be deformed is remarkably suppressed, with the result that the vibration and noise of the spindle are greatly reduced during operation of the spinning machine. The arrangement described in connection with FIG. 5 increases the rigidity of the tubular structure also in the axial direction, so that the tubular structure also exhibits an increased resistance to any force which acts to bend the tubular structure along the axis thereof. In consequence, any tendency of the tubular structure to vibrate due to unbalanced mass or to be radially offset by magnetic attracting force is suppressed to reduce vibration, thus preventing the critical or resonance speed from being lowered.

The ring 1*d* provided on the free end of the thin-walled cylindrical portion 1*f* may be made of a ferromagnetic material. In such a case, the reactance component of the spindle motor 20 is so increased that the higher harmonic components of the driving electric power can be suppressed, whereby the driving characteristics can be improved. This feature is advantageous particularly when the spindle motor 20 is driven by a switching power supply such as an inverter.

It is also possible to make use of the thick-walled ring 1*d* as a balancing ring. Namely, it is possible to correct any unbalance of mass of the spindle 1 by making use of the thick-walled ring 1*d* without difficulty. Obviously, well-balanced spindle 1 can be rotated at a higher speed.

During high speed operation of the spindle, the motor rotor 3 tends to expand radially outwardly. In order to prevent such a radial expansion of the motor rotor 3, therefore, it is necessary that the motor rotor 3 fits on the spindle 1 with a sufficient tightening margin. A too large tightening margin, i.e., a too large contracting force applied by the motor rotor 3 on the spindle 1, causes a risk that the tubular structure, particularly the thin-walled cylindrical portion 1*f*, is collapsed due to buckling. This problem, however, is overcome by the arrangement shown in FIG. 5 because the upper end portion of the rotor core 3*b* rests on the thick-walled portion of the wharve 1*b* while the lower end portion of the same is formed as the thick-walled ring 1*d* so that the tightening contracting force can be borne by the thick-walled portion of the wharve 1*b* and the thick-walled ring 1*d* thereof.

The features offered by the arrangement shown in FIG. 5 is advantageous particularly in a spindle 1 incorporating a motor rotor 3 having a diameter ratio (inside diameter/outside diameter) not smaller than 0.5.

Figure 6:
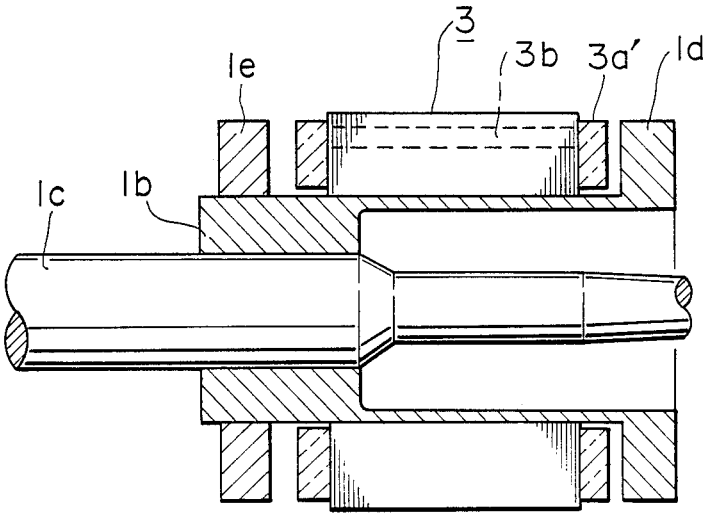

FIG. 6 shows another form of the further embodiment in which the end ring 3*a'* of the motor rotor 3 is extended radially inwardly and the thick-walled ring 1*d* is placed underneath and in the vicinity of the end ring 3*a'*. In addition, an annular balance ring 1*e* is provided on the wharve 1*b* of the motor rotor 3. In this case, the thick-walled ring 1*d* is made of a ferromagnetic material so that the reactance is increased in the region where this ring 1*d* exists, thereby reducing the influence of the higher harmonics of the driving electric power.

Figure 7:
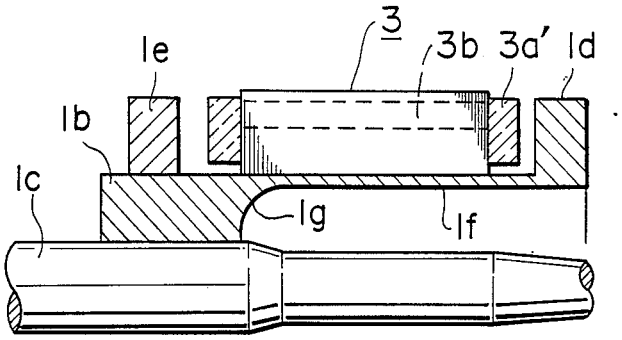
Figure 8:
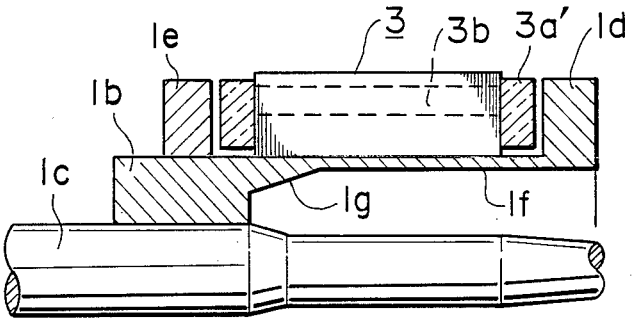

FIGS. 7 and 8 show different forms of the further embodiment. In these forms, a thickened portion 1*g* of a certain thickness is provided between the upper end portion of the thin-walled cylindrical portion 1*f* and the upper thick-walled portion of the wharve 1*b* and the upper portion of the rotor core 3*b* is placed over the thickened portion 1*g*. This arrangement also increases the rigidity of the rotational portion of the spindle motor 20.

Figure 9:
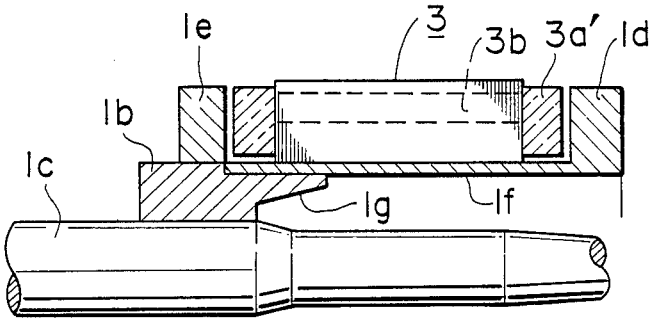

FIG. 9 shows an arrangement in which a thin-walled cylindrical portion 1*f* with an integral thick-walled ring 1*d* at the lower end is formed separately from the wharve 1*b* and is suitably connected to the wharve 1*b*.

As has been described, the invention provides a ring spinning machine having a direct drive spindle and so constructed that the length of the unsupported portion of the spindle is decreased to increase the resonance or critical rotation speed so as to enable the spindle to rotate at higher speed than known spindles, thus improving the spinning efficiency of the spinning apparatus.

What is claimed is:

1. A ring spinning machine including:

a bolster having an upper bearing provided in an upper portion thereof and a foot step bearing provided in a lower portion thereof;

a spindle rotatably supported by the bolster and carrying a bobbin for winding yarn thereon;

a substantially cylindrical ring having an upper end provided with a traveler for guiding the yarn to said bobbin;

a ring rail connected with a base portion of said ring and capable of moving said ring up and down in the direction of the axis of said spindle; and a spindle motor having a motor rotor including a rotor core fixed to said spindle and secondary windings on said rotor core and a motor stator including a cylindrical stator core surrounding said rotor core leaving an annular gap therebetween and a stator winding on said stator core;

wherein said stator winding of said motor stator has an upper coil end which projects above the upper end surface of said stator core;

said upper coil end has an outside diameter smaller than the outside diameter of said stator core;

said upper bearing is disposed substantially at the center of said motor rotor; and said ring has an inside diameter greater than the outside diameter of said upper coil end so that said ring together with said ring rail can be lowered to a level where said upper coil end is received in said ring.

2. A ring spinning machine according to claim 1, further including a stator frame and an end cover which covers the upper end of said stator frame and has an outside diameter smaller than the inside diameter of said ring.

3. A ring spinning machine according to claim 1, further including a stator frame fitted on the outer peripheral surface of said stator core, said stator frame having a lower end connected to said bolster and an open upper end.

4. A ring spinning machine according to claim 1, wherein said ring has a base end portion having an inside diameter greater than the outside diameter of said upper coil end and fixed to said ring rail, and an upper end portion the diameter of which is progressively decreased towards the upper end of said ring.

5. A ring spinning machine according to claim 1, further including a stator frame supporting said stator core and extended from said bolster, said stator frame having an upper end provided with an end cover which covers said upper coil end of said stator winding and has an outer diameter smaller than the outside diameter of said stator core, said ring having an inside diameter greater than the outside diameter of said end cover so that said ring and said ring rail can be lowered to a level where said end cover is received at least partially in said ring.

6. A ring spinning machine according to claim 5, wherein said stator frame is fitted on the outer peripheral surface of said stator core and is fixed at its lower end to said bolster while its upper end is extended to the same level as the upper end surface of said stator core.

7. A ring spinning machine according to claim 10, further including a thin-walled cylindrical member fitted in said rotor core of said spindle motor, said thin-walled cylindrical member having an upper end connected to said spindle and provided at its lower end thereof with a thick-walled portion.

8. A ring spinning machine including:

a bolster having an upper bearing provided in an upper portion thereof and a foot step bearing provided in a lower portion thereof;

a spindle rotatably supported by the bolster and carrying a bobbin for winding yarn thereon;

a generally cylindrical wharve having a first upper thick-walled portion with an inner peripheral surface connected to said spindle, a second lower thick-walled portion spaced from said spindle and an intermediate thin-walled cylindrical portion disposed between said first and second thick-walled portions;

a spindle motor having a motor rotor including a rotor core fixed to said wharve and secondary windings on said rotor core and a motor stator including a cylindrical stator core surrounding said rotor core leaving an annular gap therebetween and a stator winding on said stator core;

wherein said rotor core is fixed to an outer peripheral surface of said intermediate thin-walled cylindrical portion.

9. A ring spinning machine according to claim 8, wherein said second thick-walled portion is in the form of a ring located under a lower part of said rotor core and wherein an annular balance ring is provided on an upper portion of said wharve and located above an upper end of said rotor core.

10. A ring spinning machine according to claim 9, wherein said wharve is provided with a thickened portion at the upper part of an inner peripheral surface thereof.

11. A ring spinning machine according to claim 10, wherein said thickened portion is tapered such that the thickness thereof is decreased towards the lower part of said wharve.

12. A ring spinning machine according to claim 11, wherein said intermediate thin-walled cylindrical portion is formed separately from but fixed to said first thick-walled portion of said wharve.

13. A ring spinning machine according to claim 8, wherein said rotor core is fixed to said wharve such that a lower end of said rotor core extends to said second thick-walled portion of said wharve and an upper end portion of said rotor core extends to said first thick-walled portion of said wharve.

14. A ring spinning machine according to claim 8, wherein said rotor core is fixed to said wharve such that a lower end portion of said rotor core is spaced upwardly from said second thick-walled portion of said wharve and an upper end portion of said rotor core extends to said first thick-walled portion of said wharve.

* * * * *